US011311911B2

(12) United States Patent
Eggersmann

(10) Patent No.: US 11,311,911 B2
(45) Date of Patent: Apr. 26, 2022

(54) SEPARATING DEVICE

(71) Applicant: Kompoferm GmbH, Marienfeld (DE)

(72) Inventor: Karlgünter Eggersmann, Marienfeld (DE)

(73) Assignee: Kompoferm GmbH, Marienfeld (DE)

( * ) Notice: Subject to any disclaimer, the term of this patent is extended or adjusted under 35 U.S.C. 154(b) by 0 days.

(21) Appl. No.: 17/049,625

(22) PCT Filed: May 13, 2019

(86) PCT No.: PCT/EP2019/062121
§ 371 (c)(1),
(2) Date: Oct. 22, 2020

(87) PCT Pub. No.: WO2019/219552
PCT Pub. Date: Nov. 21, 2019

(65) Prior Publication Data

US 2021/0245200 A1 Aug. 12, 2021

(30) Foreign Application Priority Data

May 15, 2018 (EP) ..... 18172287

(51) Int. Cl.
*B07B 4/02* (2006.01)
*B07B 9/02* (2006.01)
(Continued)

(52) U.S. Cl.
CPC ..... *B07B 4/02* (2013.01); *B02B 3/08* (2013.01); *B07B 9/02* (2013.01); *B07B 11/02* (2013.01); *B07B 11/04* (2013.01)

(58) Field of Classification Search
CPC .... B07B 4/02; B07B 7/04; B07B 9/02; B07B 11/02; B07B 7/00; B07B 7/01; B07B 9/00; B07B 11/06
See application file for complete search history.

(56) References Cited

U.S. PATENT DOCUMENTS 5,209,355 A 5/1993 Mindermann
7,104,403 B1 * 9/2006 Stephens ..... B07B 7/04 209/132
(Continued)

FOREIGN PATENT DOCUMENTS

DE 1167635 B 4/1964
FR 975556 A 3/1951
(Continued)

OTHER PUBLICATIONS

WIPO, International Search Report (on a related application), dated Aug. 22, 2019.

*Primary Examiner* — Michael McCullough
*Assistant Examiner* — Jessica L Burkman
(74) *Attorney, Agent, or Firm* — Laurence P. Colton; Smith Tempel Blaha LLC

(57) ABSTRACT

A separating device for separating different material fractions out of a feed-material mixture having a flow channel, which has a slope, extends in parallel with the direction of gravity in particular in its main longitudinal extension direction and comprises an inner chamber. The separating device has a first end region, a second end region, a material inlet region intended for feeding the feed-material mixture into the inner chamber of the flow channel, an outlet through which an air stream containing a lightweight material can exit the flow channel, at least one conveying means that conveys air through the flow channel, and a cross-flow device that has a separation chamber and an air intake that leads into said chamber and through which the cross-flow device can introduce air into the separation chamber in a flow direction extending at an angle to the main longitudinal extension direction of the flow channel.

15 Claims, 7 Drawing Sheets

(51) Int. Cl.

| | |
|---|---|
| ***B07B 11/02*** | (2006.01) |
| ***B07B 11/04*** | (2006.01) |
| ***B02B 3/08*** | (2006.01) |

(56) References Cited

U.S. PATENT DOCUMENTS

| | | | | |
|---|---|---|---|---|
| 8,957,340 | B2 * | 2/2015 | Wellwood | B07B 4/02 209/21 |
| 2010/0163463 | A1 * | 7/2010 | Dal Ben | B07B 4/02 209/21 |

FOREIGN PATENT DOCUMENTS

| | | | |
|---|---|---|---|
| GB | 403115 | A | 12/1933 |
| GB | 1498767 | A | 1/1978 |
| GB | 2067924 | A | 8/1981 |
| JP | H06106135 | A | 4/1994 |

* cited by examiner

SEPARATING DEVICE

CROSS REFERENCE TO RELATED APPLICATIONS

This application is the US National Phase of and claims the benefit of and priority on International Application No. PCT/EP2019/062121 having an international filing date of 13 May 2019, which claims priority on European Patent Application No. 18172287.7 having a filing date of 15 May 2018.

BACKGROUND OF THE INVENTION

Technical Field

The invention relates to a separating device.

Prior Art

When treating a material mixture, a material stream has to be separated into different fractions. It is known to split a material stream into fractions of different grain sizes through screening, for example using a rotary drum screen, a vibrating screen or the like; in the process, screen rejects usually occur for the larger fraction, the rejects producing portions having a grain size of between approximately 10 and 80 mm and higher, for example in the area of fines treatment in biowaste composting. These rejects still contain portions that have to be separated further in a subsequent separation process. For example, lightweight portions such as films are present and have to be separated out of the mixture.

In particular when separating lightweight, dispersible portions from heavy portions, the air classification process is advantageous; however, the problem remains that while that process does separate relatively lightweight objects from heavy objects, organic matter-containing material and other material, for example, remain mixed together during the process.

BRIEF SUMMARY OF THE INVENTION

The object of the present invention is therefore to provide a separating device by which a material stream from screen rejects can be split into a plurality of fractions and, in particular, inert material containing organic matter can be separated from other material more effectively.

This object is achieved by a separating device for fractionally separating different material out of a feed-material mixture, comprising: a flow channel, which has a slope, extends in parallel with the direction of gravity in particular in its main longitudinal extension direction, and comprises an inner chamber, a first end region and a second end region opposite the first end region; a material inlet region arranged between the first end region and the second end region and intended for feeding the feed-material mixture into the inner chamber of the flow channel; an outlet, which is arranged above the material inlet region in the first end region of the flow channel and through which an air stream, in particular containing a lightweight material, can exit the flow channel; at least one conveying means, which conveys air through the flow channel; a cross-flow device, which is connected to the second end region of the flow channel in flow communication with the flow channel and has a separation chamber and an air intake, which leads into said chamber and through which the cross-flow device can introduce air into the separation chamber in a flow direction extending at an angle to the main longitudinal extension direction of the flow channel, wherein the separation chamber has at least one first separation region positioned adjacent to the air intake, and a second separation region positioned further away from the air intake in comparison with the first separation region, wherein a separation apparatus formed in particular as a baffle element is arranged between the first and the second separation region. Advantageous embodiments can be found in the dependent claims.

In this respect, the separating device according to the invention for fractionally separating different material out of a feed-material mixture comprises a flow channel, which has a slope and extends in parallel with the direction of gravity in particular in its main longitudinal extension direction. This flow channel has an inner chamber, a first end region and a second end region opposite the first end region. A material inlet region is arranged between the first end region and the second end region and is used to feed the feed-material mixture into the inner chamber of the flow channel. An outlet is arranged above the material inlet region in the first end region of the flow channel, through which outlet an air stream, in particular containing a lightweight material, can exit the flow channel. The separating device according to the invention further comprises at least one conveying means, which conveys air through the flow channel. Preferably, the air is conveyed out of the above-described outlet through suction. Preferably, the feed-material mixture should be free from or low in fine grains, i.e. portions having grain sizes of for example less than 5 mm should, at least largely, not be contained.

At the second end region of the flow channel, the separating device according to the invention further comprises a cross-flow device connected in flow communication with the flow channel. In turn, said cross-flow device comprises a separation chamber and an air intake, which leads into said chamber and through which the cross-flow device introduces air into the separation chamber in a flow direction extending at an angle to the main longitudinal extension direction of the flow channel. The separation chamber comprises at least one first separation region positioned adjacent to the air intake, and at least one second separation region positioned further away from the air intake in comparison with the first separation region. A separation apparatus formed in particular as a baffle element is arranged between the first and the second separation region.

The separating device according to the invention combines a falling-stream screening process with cross-flow screening. In this way, lightweight portions in the flow channel, such as films, are first extracted from the fed-in material towards the outlet. Due to the flow directed upwards towards the outlet, relatively heavy materials falling downwards are braked to different extents as they fall depending on their density and mass, and they reach the region of the separation chamber in which they are blown by a cross-flow and separated further since heavy portions, such as rocks or the like, land in the first separation region or are reflected towards said region by the separation apparatus; by contrast, the cross-flow conducts the lighter fraction past the separation apparatus and into the at least one further separation region. Due to the different braking of the material portions falling down in the flow channel, in particular lightweight portions with a high organic matter content, such as wood portions, can be separated from the other portions of the material stream more easily in the separation chamber.

According to an advantageous embodiment of the present invention, beneath the material inlet region the flow channel can have at least one, in particular adjustable air intake. An air intake of this kind enables additional suction of air.

Particularly advantageously, a flow-guiding surface is arranged in the separation chamber. In this way, the cross-flow blown into the separation chamber can be deflected by means of the flow-guiding surface and introduced into the flow channel. In any case, part of the air blown into the separation chamber can thus also be used to brake material portions falling down in the flow channel.

Preferably, the flow-guiding surface can be arranged such that an air stream introduced into the separation chamber by the air intake is at least in part conducted into the flow channel between the flow-guiding surface and the separation apparatus and around the flow-guiding surface. In this way, a separation is first carried out in the separation chamber by means of the cross-flow, and then the cross-flow is diverted accordingly into the flow channel by means of the flow-guiding surface.

An embodiment in which the flow-guiding surface is arranged above the first and the second separation region, above the separation apparatus and at least in part above the air intake has proven particularly advantageous. In the process, the flow-guiding surface is arranged at a spacing from the inner wall of the separation chamber. In this way, the flow-guiding surface can be traversed by the cross-flow in the separation chamber.

According to a further preferred embodiment, on its side facing away from the separation apparatus or from the first and the second separation region, the flow-guiding surface can form a channel together with the inner wall of the separation chamber. By means of this channel, the flow can then be conducted into the flow channel beneath the separation chamber.

With regard to the shape of the flow-guiding surface, it has proven particularly advantageous for the flow-guiding surface to have a cross section that tapers in the direction of the air intake.

The separation apparatus can be a structure that is rigid in itself, although different geometric configurations are also conceivable. For example, the separation apparatus can be formed as a drum or belt. Preferably, the separation apparatus is configured to be movable. In this way, the separation behavior of the separation apparatus, i.e. which material portions are to be separated by it, can be adjusted in a customized manner depending on the type of matter to be separated. In particular, the separation apparatus can be pivotable and/or slidable and/or rotatable. If the separation apparatus is rotatable, it can in particular be a separation apparatus that has an adjustable speed and/or adjustable direction of rotation.

According to a preferred embodiment, the separating device according to the invention can be designed to separate even further the material portions separated in the separation region. In particular, for example, at the lower end in relation to the direction of gravity the first separation region can branch at least into a first separation sub-region and a second separation sub-region separate therefrom. In the process, a first material-flow means is arranged in the first separation region and is configured to cause a flow against separated material falling into the first separation region. The same can similarly be provided for the second separation sub-region, in which, at the lower end in relation to the direction of gravity, the second separation region can branch at least into a first and a second separation sub-region. In the process, a second material-flow means is arranged in the second separation region and is configured to cause a flow against separated material falling into the second separation region. As a result of the flow, a short pressure pulse can deflect falling portions one more time and separate them from the other falling materials. Particularly advantageously, the flow takes place in batches or selectively.

In such case, for example, the first and/or second separation region can comprise at least one detection means, which is designed to recognize a particular material out of a substance mixture. The recognizing then helps identify certain material portions out of a mixture in a targeted manner, segregate them and then selectively flow into them. In the process, a controller is preferably provided, which, in response to a material portion recognized by the detection means, temporarily activates the first and/or second material flow means to cause a flow against the identified material portion. The detection apparatus can be of any given nature. For example, it can be an NIR sensor. A sensor of this kind can be very selectively adjusted to highly specific material components of a material mixture. If the detector then detects a plastics portion, for example, a material-flow means causes flows against the portion and selectively removed from the rest of the material stream. The corresponding detector is preferably arranged above the material flow means in the falling direction so that, upon detection of a portion to be segregated, the material flow means can be activated with the appropriate time lag by means of the controller and then deactivated again so that the material flow means does not capture and segregate further portions that are not to be segregated.

The preferred medium in said process is air. In this case, the air supplied to the air intake can be fresh air and/or treated process air taken from the outlet.

According to a preferred embodiment of the present invention, the outlet of the flow channel is connected to a line in which a separator, the at least one conveying means and a filtering means are connected in series in the flow direction. The air originating from the outlet and containing lightweight material is separated from the lightweight material at the separator. The air now still contains, for example, lightweight particles such as dust or the like, which can be removed in the downstream filtering means.

In air-recirculation mode or partial air-recirculation mode, a return line leading to the air intake can in particular branch off from the line. Said return line is then led back to the separation chamber in the region of the cross-flow apparatus, namely at the air intake thereof. In air-recirculation mode or partial air-recirculation mode, the air intake for the cross-flow apparatus does not require a separate fan; the fan installed at the outlet of the flow channel can also be used for the air-recirculation mode or partial air-recirculation mode.

According to a preferred embodiment of the present invention, the branch of the return line can in particular be positioned either between the at least one conveying means and the filtering means or downstream of the filtering means in the flow direction.

BRIEF DESCRIPTION OF THE DRAWINGS

The invention will now be explained in more detail with reference to FIGS. 1-7.

The drawings show different embodiments of the separating device according to the invention.

FIG. 3 shows the separating device from FIG. 2 in a first plant configuration.

FIG. 4 shows the separating device from FIG. 2 in a second plant configuration.

FIG. 5 shows the separating device from FIG. 2 in a third plant configuration.

FIG. 6 shows a third embodiment of the separating device according to the invention.

DETAILED DESCRIPTION OF PREFERRED EMBODIMENTS

Figure 1:
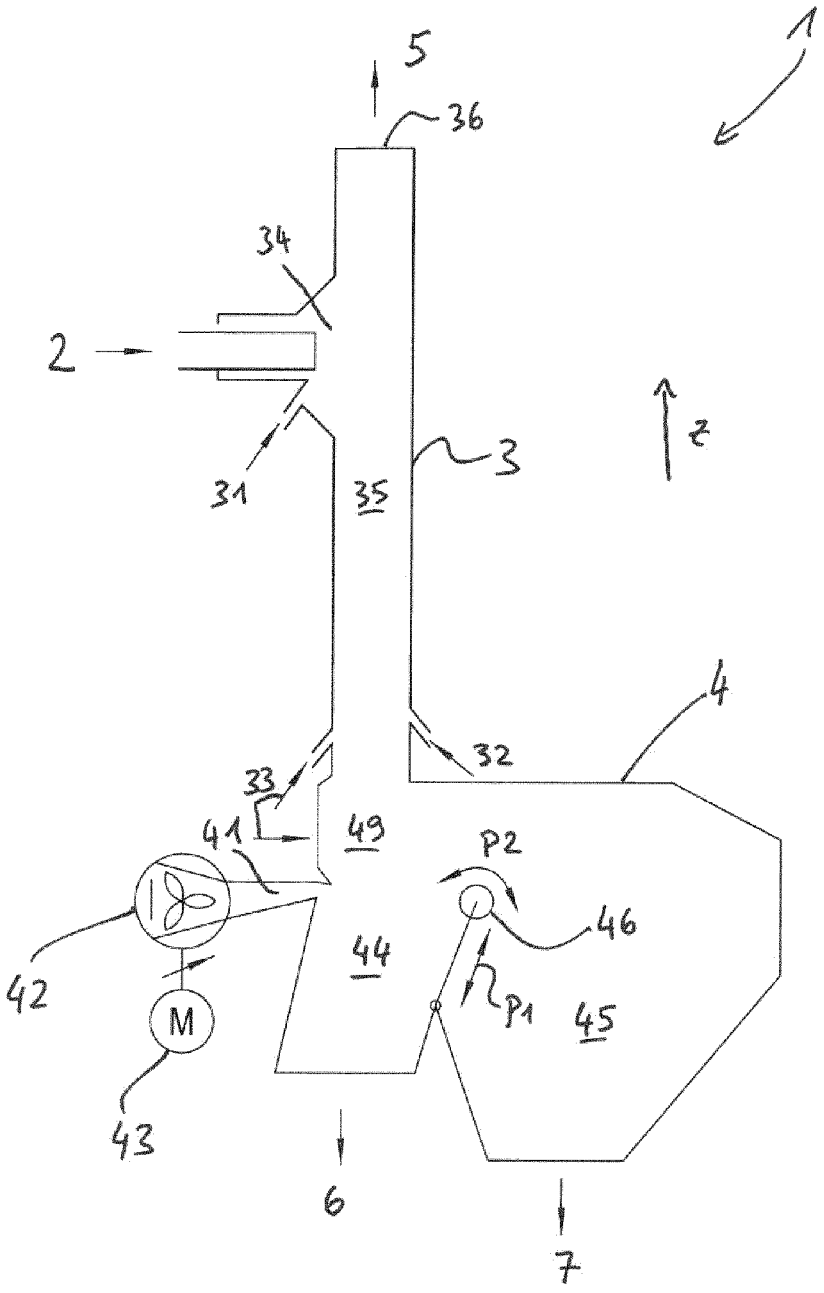
FIG. 1 shows a first embodiment of a separating device according to the invention.

The separating device 1 according to the invention shown in FIG. 1 comprises a substantially vertical flow channel 3 provided at least with a vertical component or a slope. According to the invention, an air stream 5 is generated in the vertical direction Z in the interior 35 of the flow channel 3 and leads from the lower end of the flow channel 3 to the upper end 36 thereof. Between the two ends of the flow channel 3, a material inlet region 34 is arranged, through which a material stream 2 having portions therein to be separated from one another can be introduced into the flow channel 3. The air stream 5 is preferably generated by a fan being connected downstream of the end 36 of the flow channel 3. By means of the air moving in the flow channel 3, the material 2 is sucked into the material inlet region.

Optionally, an air intake 31, 32, 33 can be provided at a plurality of points, through which intake additional air can be sucked in from the exterior. An air intake of this kind can be provided with an actuatable valve such that the suction volume can be varied.

A separation chamber is connected at the lower end of the flow channel 3, said chamber being part of a cross-flow device 4 and comprising a plurality of portions 44, 45, 49. A channel 41 is charged with air by means of a fan 42 and, in the example shown, said air is blown into the separation chamber transversely, in particular perpendicularly, to the vertical direction Z or the main longitudinal extension direction of the flow channel 3. The air volume to be blown in can be varied by means of a valve or frequency changer 43. Optionally, a further air intake 33 can also be provided here above the channel 41, said further air intake sucking air into the region 49 of the separation chamber immediately upstream of the beginning of the flow channel 3.

Adjacently to the channel 41, a first separation region 44 is present in the separation chamber. Spatially separated therefrom by means of a separation apparatus 46 is a further separation region 45. In the example shown, the separation apparatus 46 is formed as a partition that can be pivoted in the direction of the arrow P2, or extended or shortened in the direction of the arrow P1.

The device 1 according to the invention functions as follows: As described above, the air stream 5 is generated in the flow channel 3 by means of a fan, a material mixture 2 being fed to the material inlet region 34 and being sucked into the interior 35 of the flow channel 3 due to the air stream. Lighter objects in the material stream 2 are entrained by the upwardly directed flow and reach the outlet 36, whereas heavier portions fall downwards in the direction of the separation chamber under gravity. Here, they reach the region 49 of the separation chamber. Since a cross-flow is blown into the separation chamber at that location by means of the fan 42 and the channel 41, the portions of the material mixture that are present in the region 49 are captured due to the cross-flow and thrown in the direction of the separation apparatus 46. In the process, the harder and/or heavier portions bounce off the separation apparatus 46 and fall into the region 44, from where they can be removed via the outlet 6. The lighter and/or softer portions that are captured by the cross-flow and are accelerated over the separation apparatus 46 by the air stream or entrained thereby reach the region 45 therebehind and can be removed via the outlet 7. By changing the position of the separation apparatus 46 in the separation chamber, a fine adjustment can be carried out to ensure that the correct portions land in the correct separation region 44, 45. In an advantageous embodiment, the inflow direction of the cross-flow can be varied by making the fan pivot along with the channel 41, for example.

Due to the upward flow of air occurring in the flow channel 3, the falling portions from the material mixture 2 are also braked to different extents in their downward movement depending on their density. This allows for considerably more effective separation in the separation chamber, since the falling portions have lower kinetic energy compared with a freefall, and can thus be deflected more effectively by means of the cross-flow through the channel 41.

Figure 2:
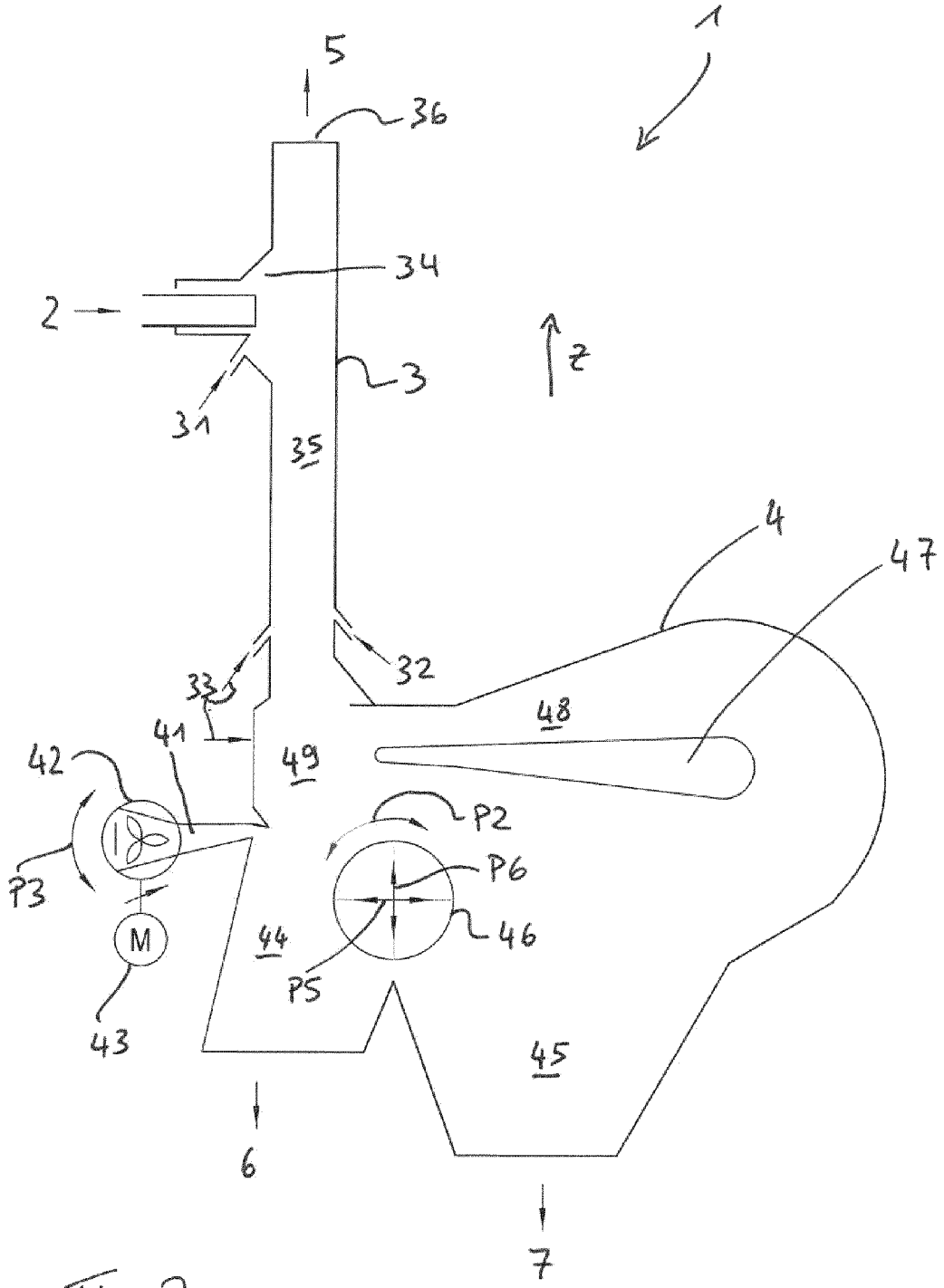
FIG. 2 shows a second embodiment of a separating device according to the invention.

The device shown in FIG. 2 differs from the embodiment according to FIG. 1 on account of two points. Firstly, in the example shown, the separation apparatus 46 is arranged between the two separation regions 44 and 45 in the form of a rotatable (arrow P2) drum that can be slid in two directions in space P5, P6; secondly, a guiding surface 47 is provided in the separation chamber and ensures that the air flowing through the channel 41 not only leads to portions of the falling material mixture reaching the separation regions 44 and 45, but also generates an air flow which, in the drawing, first arrives under the guiding surface 47, then around the guiding surface 47 at the end thereof facing away from the channel 41, via a flow path 48 positioned between the guiding surface 47 and the wall of the separation chamber, and lastly back at the region 49, from where it reaches the flow channel 3. By means of this measure, therefore, an additional air flow is achieved, which further reinforces the lift in the flow channel 3.

Figure 3:
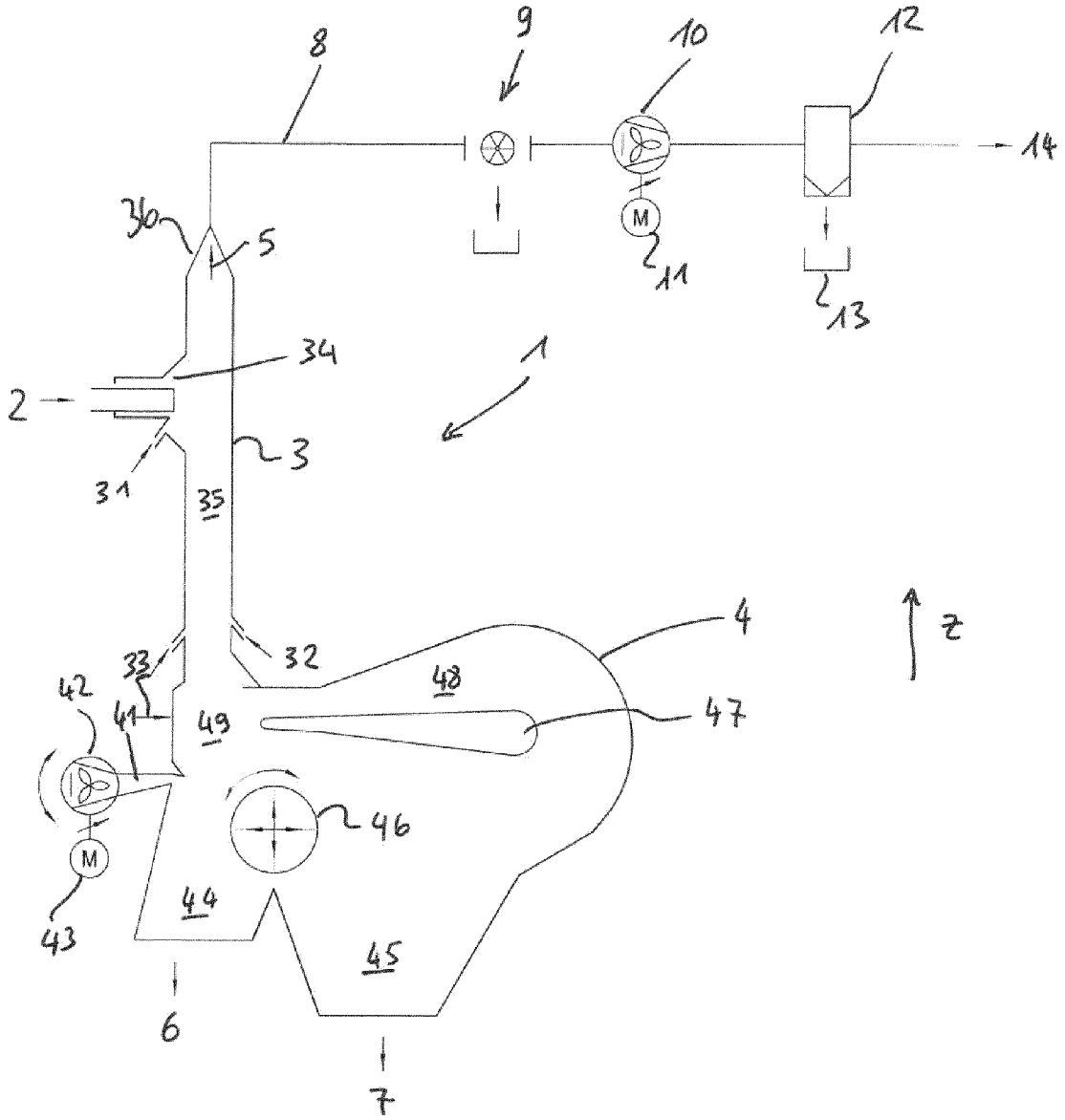
FIGS. 3-6 in particular additionally show, by way of example, various possible plant configurations, i.e. interconnection options for the separating device according to the invention within a plant, using the example of a separating device according to the invention. Although these illustrations are given with reference to an example separating device according to the invention, the associated configurations apply equally to all possible separating devices according to the invention and should thus not be understood such that the corresponding plant configurations are limited to the example embodiment shown in each of FIGS. 3-6.
Figure 4:
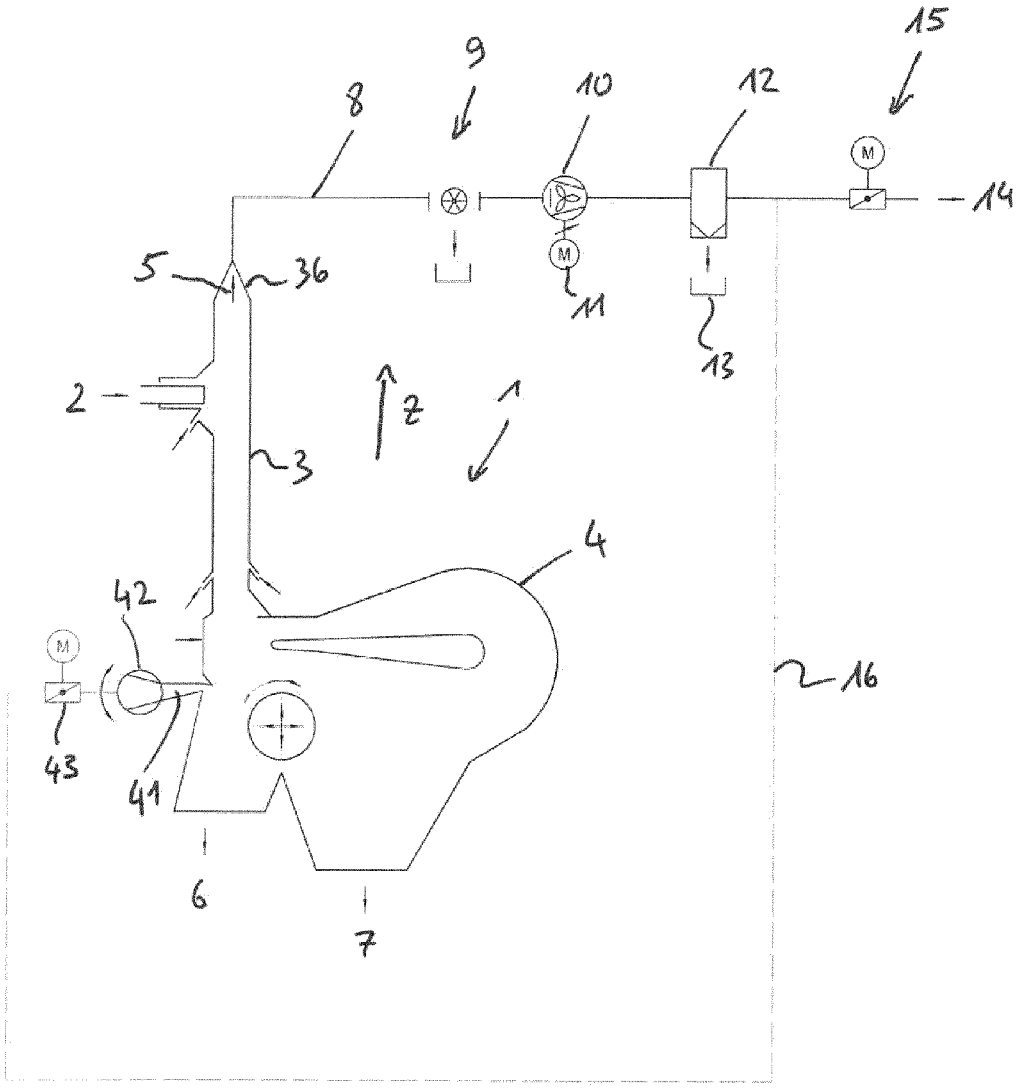
Figure 5:
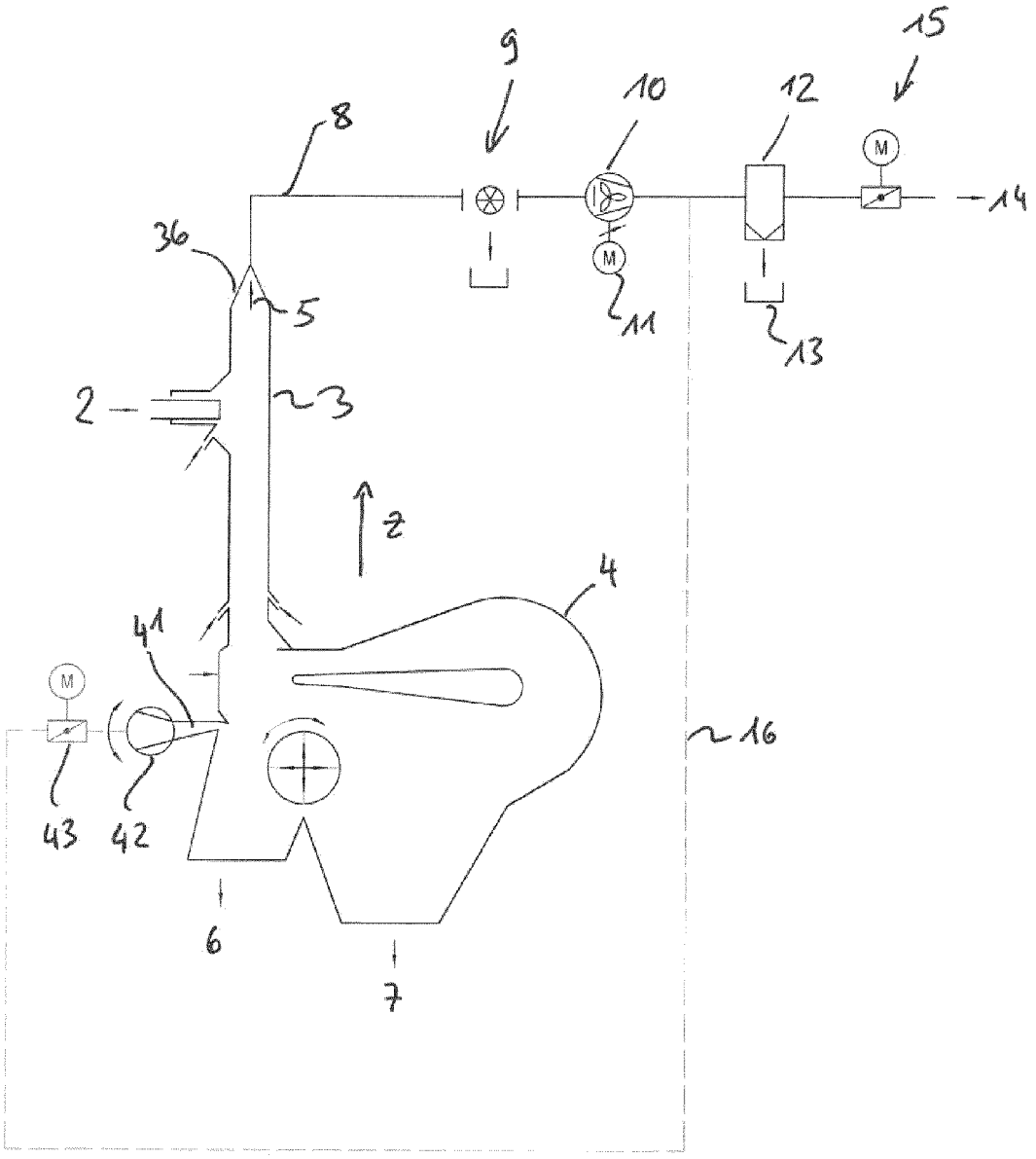

By way of example, FIGS. 3-5 show the separating device 1 depicted in FIG. 2 in the plant wiring diagram. The air flowing upwards through the flow channel 3, which air is sucked in by a fan 10 and entrains the lightweight material that is not falling down in the flow channel 3 under gravity as well as dust particles and the like, enters a line 8 at the output of the flow channel. Initially, the air loaded in this manner reaches a separator 9, at which lightweight portions, such as films, paper or the like, present in the air stream are separated out. The air flowing through the fan 10 then reaches a filter 12, at which particles remaining in the air are filtered out and, where applicable, collected in a collection apparatus 13, whereas the cleaned air 14 leaves the line 8 downstream of the filter 12. In the embodiment according to FIG. 3, the system operates by sucking in fresh air, the fan 42 for the cross-flow also blowing fresh air into the system.

It is also possible, however, to use an air-recirculation mode or partial air-recirculation mode, in which at least some portions of the cleaned air are not removed from the line 8 but rather are fed back into the region of the air intake 41 (in this case the fan is optional). This version is shown in an embodiment in FIG. 4. The air sucked in by means of the fan 10 reaches the above-described filter 12 after passing through the separator 9. A return line 16 is connected downstream of the filter 12 and feeds air cleaned by the filter 12 back into the fan 42, from which it can be then blown back into the separation chamber by means of the channel 41. The fan 10 (and optionally also 42) can of course be adjustable in terms of conveying capacity by means of corresponding control devices 11 and 43, respectively. In the example shown, a further valve 15 is also illustrated, which is placed downstream of the branch of the return line 16. By means of this valve 15, it is possible to adjust which proportion of the cleaned air coming from the filter 12 is diverted into the return line 16.

Figure 6:
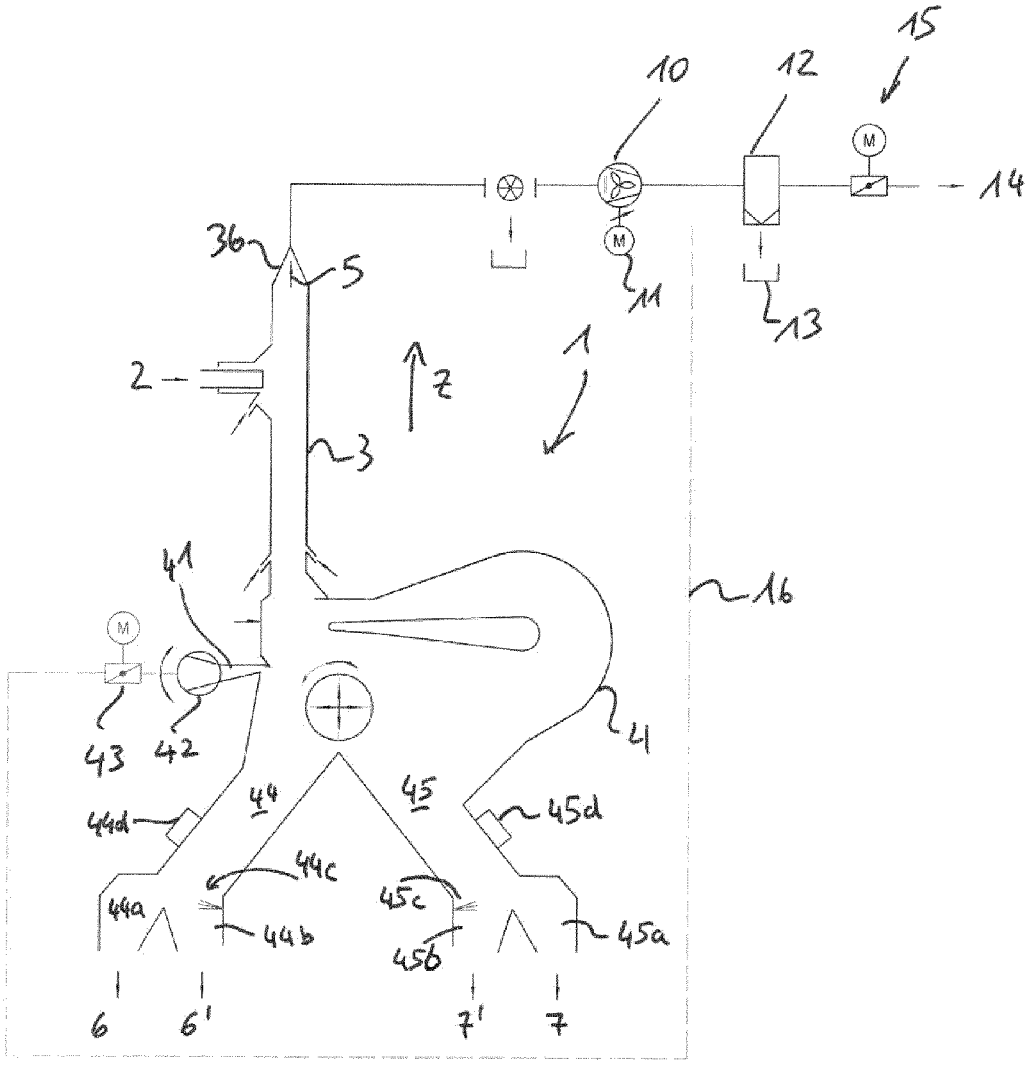

FIG. 5 shows a variant of the configuration shown in FIG. 4, the only difference being that in this figure the return line 16 is positioned between the fan 10 and the filter 12. This configuration is particularly advantageous if the dimensioning of the filter 12 is important, since in this case the energy use is minimized due to smaller volume flow rates through the filter 12. According to an advantageous embodiment, a slightly modified separating device 1 can also be used for this configuration, as shown in FIG. 6.

In this case, the two separation portions 44 and 45 are again split into respective separation sub-portions 44*a* and 44*b* on one side and 45*a* and 45*b* on the other side. In this way, materials that reach the separation regions 44 and 45 can be separated from one another one more time and collected in corresponding outlets 6, 6' and 7', 7. The material falling into the regions 44 and 45 is recorded by means of detectors 44*d* and 45*d*, respectively. The detectors 44*d* and 45*d* can preferably be designed such as to be able to recognize particular materials (e.g. plastics material, wood) out of a material stream. For example, the detectors can be those based on NIR technology. By means of a controller (not shown), detected portions can then be blown, in a targeted manner, by means of material flow means, which can be small air nozzles, transversely to the falling direction and then brought into the corresponding separation sub-portions 44*a* and 45*a*.

Of course, it is not necessary for every separation portion 44 and 45 to have corresponding separation sub-portions; it is equally sufficient for just one of the separation portions to have this additional division.

Figure 7:
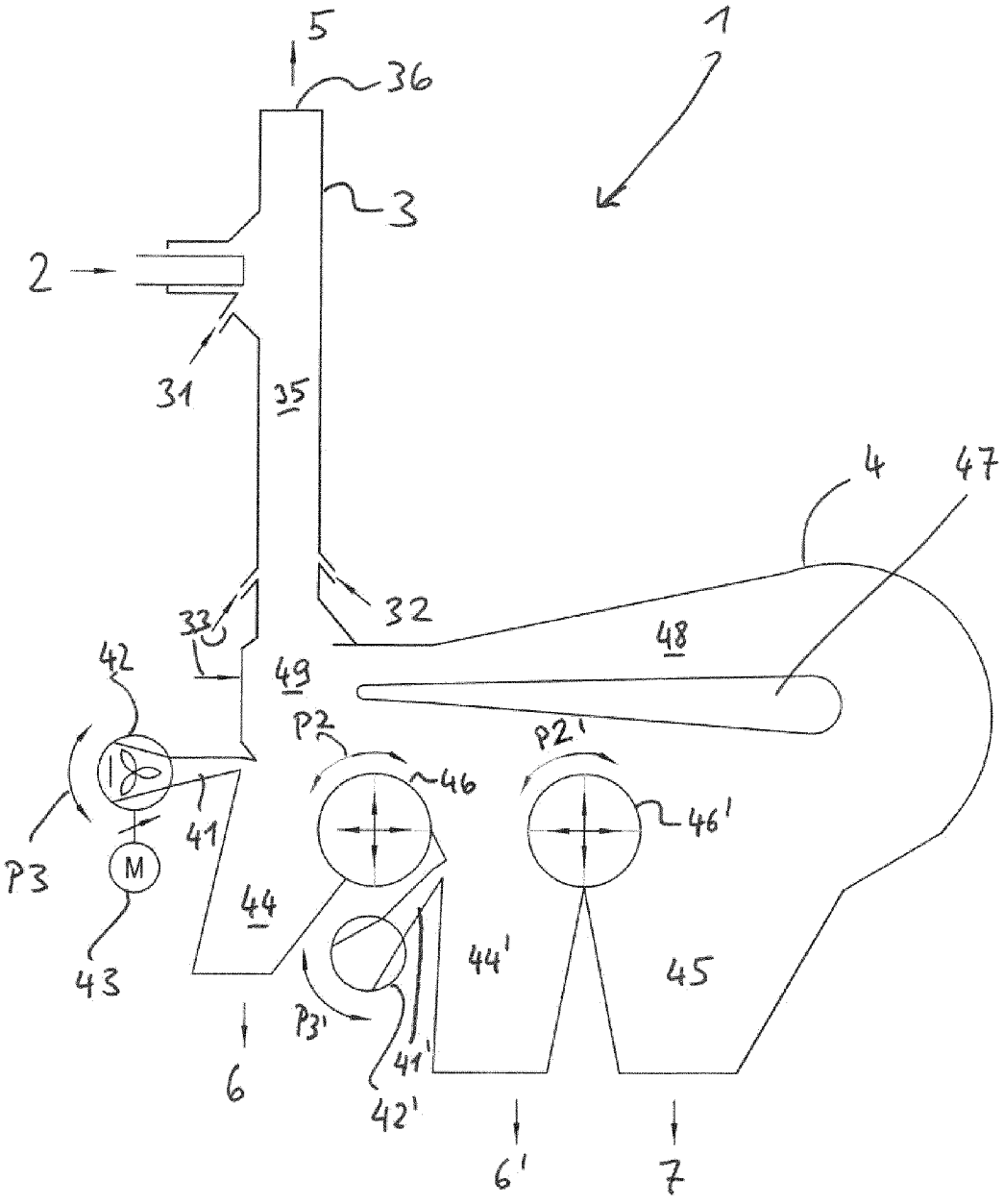
FIG. 7 shows a fourth embodiment of the separating device according to the invention.

Lastly, FIG. 7 depicts a further embodiment of the separating device 1 according to the invention. Unlike the embodiments illustrated previously, the separating device 1 according to the invention can comprise more than two separation portions in the region of the separation chamber. In FIG. 7, the separating device 1 comprises a total of three separation portions 44, 44' and 45. The air blown into the separation chamber through the channel or air intake 41, which is in particular pivotable (P3) together with the fan 42, is separated at a first separation apparatus 46 as described above, and portions from the air stream reach the separation regions 44 and 44'. A second separation apparatus 46' is provided downstream of the first separation apparatus 46. If more than three separation regions are provided, the number of separation apparatuses should be increased accordingly. In the example shown, a further air intake 41' is additionally provided downstream of the first separation apparatus, along with a fan 42' which loads said intake and can also be pivoted (P3') in order to change the inflow direction. It is also possible that portions fall down in the region 44' downstream of the first separation apparatus 46 or are retained by the second separation apparatus 46' but should not actually be collected in those locations. Both the first and the second separation apparatus 46, 46' and any further separation apparatuses can again be rotatable (P2, P2') and/or slidable or formed as simple partitions, as already described above.

By means of the second air intake 41', a further cross-flow is generated, which ensures that corresponding portions reach the region 45, where they can then be removed at 7. Portions from the separation region 44 can be removed at 6, and portions from the separation region 44' can accordingly be removed at 6'.

It goes without saying that this embodiment of the separating device according to the invention can be combined in any manner with the other separating devices according to FIGS. 1-6. In particular, any number of separation regions can be provided, and accordingly any number of separation sub-regions can also be provided.

By means of the device according to the invention, material mixtures can be split into different fractions, the device according to the invention being particularly suitable for separating out inert, organic matter-containing fractions and lightweight fractions from a material stream.

The invention claimed is:

1. A separating device (1) for fractionally separating different material out of a feed-material mixture (2), comprising:

a flow channel (3), which has a slope, extends in parallel with the direction of gravity in its main longitudinal extension direction (Z), and comprises an inner chamber (35), a first end region and a second end region opposite the first end region;

a material inlet region (34) arranged between the first end region and the second end region and intended for feeding the feed-material mixture (2) into the inner chamber (35) of the flow channel (3);

an outlet (36), which is arranged above the material inlet region (2) in the first end region of the flow channel (3) and through which an air stream (5), containing a lightweight material, can exit the flow channel (3);

at least one conveying means (10, 42), which conveys air through the flow channel (3); and a cross-flow device (4), which is connected to the second end region of the flow channel (3) in flow communication with the flow channel (3) and has a separation chamber (44, 45, 49) and an air intake (41), which leads into said chamber and through which the cross-flow device (4) can introduce air into the separation chamber (44, 45, 49) in a flow direction extending at an angle to the main longitudinal extension direction (Z) of the flow channel (3), wherein the separation chamber (44, 45, 49) has at least one first separation region (44) positioned adjacent to the air intake (41), and a second separation region (45) positioned further away from the air intake (41) in comparison with the first separation region, wherein a separation apparatus (46) formed as a baffle element is arranged between the first and the second separation region (44, 45).

2. The separation device (1) according to claim 1, wherein, beneath the material inlet region (2), the flow channel (3) has at least one adjustable air intake (31, 32, 33) and the flow channel (3) is located above the separation chamber (44, 45, 49).

3. The separating device (1) according to claim 2, further comprising a flow-guiding surface (47) arranged in the separation chamber (44, 45, 49).

4. The separating device (1) according to claim 3, wherein the flow-guiding surface (47) is arranged such that an air stream introduced into the separation chamber (44, 45, 49) through the air intake (41) is at least in part conducted into the flow channel (3) between the flow-guiding surface (47) and the separation apparatus (46) and around the flow-guiding surface (47).

5. The separating device (1) according to claim 3, wherein airflow within the flow channel (3) is in an upward direction against the direction of gravity in the flow channel (3), the flow-guiding surface (47) is arranged above the first and the second separation region (44, 45), above the separation apparatus (46) and at least in part above the air intake (41), the flow-guiding surface (47) being arranged at a spacing from the inner wall of the separation chamber (44, 45, 49).

6. The separating device (1) according to claim 3, wherein, on its side facing away from the separation apparatus (46) or from the first and the second separation region (44, 45), the flow-guiding surface (47) forms a channel (48) together with the inner wall of the separation chamber (44, 45, 49).

7. The separating device (1) according to claim 3, wherein the flow-guiding surface has a cross section that tapers in the direction of the air intake (41).

8. The separating device (1) according to claim 1, wherein the separation apparatus (46) is movable in a pivotable and/or slidable, and/or rotatable manner, at an adjustable speed and/or in an adjustable direction of rotation.

9. The separating device (1) according to claim 1, wherein, at the lower end in relation to the direction of gravity, the first separation region (44) branches at least into a first separation sub-region (44*a*) and a second separation sub-region (44*b*) separate therefrom, a first material flow means (44*c*) being arranged in the first separation region (44) and being configured to cause a flow against separated material falling into the first separation region (44).

10. The separating device (1) according to claim 9, wherein, at the lower end in relation to the direction of gravity, the second separation region (45) branches at least into a first and a second separation sub-region (45*a*, 45*b*), a second material flow means (45*c*) being arranged in the second separation region (45) and being configured to cause a flow against separated material falling into the second separation region (45).

11. The separating device (1) according to claim 10, wherein the first and/or second separation region (44, 45) comprises at least one detection means (44*d*, 45*d*), which is designed to recognize a particular material out of a substance mixture, a controller being provided, which, in response to a material portion recognized by the detection means (44*d*, 45*d*), temporarily activates the first and/or second material flow means (44*c*, 45*c*) to cause a flow against the recognized material portion.

12. The separating device (1) according to claim 1, wherein the air supplied to the air intake (41) is fresh air and/or treated process air taken from the outlet (36).

13. The separating device (1) according to claim 1, wherein the outlet (36) is connected to a line (8) in which a separator (9), the at least one conveying means (10) and a filtering means (11) are connected in series in the flow direction.

14. The separating device (1) according to claim 13, further comprising a return line (16) leading to the air intake (41) that branches off from the line (8).

15. The separating device (1) according to claim 14, wherein the branch of the return line (16) is positioned either between the at least one conveying means (10) and the filtering means (12) or downstream of the filtering means (12) in the flow direction.

* * * * *